US005178246A

United States Patent [19]

Kramer

[11] Patent Number: 5,178,246

[45] Date of Patent: Jan. 12, 1993

[54] UTILITY COMPONENT BRIEFCASE

[76] Inventor: Paul D. Kramer, 708 University Ave., Rochester, N.Y. 14607

[21] Appl. No.: 709,450

[22] Filed: May 29, 1991

[51] Int. Cl.[5] ..... A45C 13/04

[52] U.S. Cl. ..... 190/109; 190/31; 190/111; 190/901

[58] Field of Search ..... 190/109, 110, 111, 30, 190/31, 900, 901

[56] References Cited

U.S. PATENT DOCUMENTS

| | | | |
|---|---|---|---|
| 571,124 | 11/1896 | Hurd | 190/31 |
| 763,395 | 6/1904 | Hawley | 190/31 |
| 1,292,493 | 1/1919 | Logan | 190/109 |
| 1,510,763 | 10/1924 | Canal | 190/110 |
| 1,830,582 | 11/1931 | Wheary et al. | 190/109 |
| 1,915,007 | 6/1933 | Weiss | 190/901 |
| 1,950,252 | 3/1934 | Lewis | 190/111 |
| 1,983,036 | 12/1934 | Kaufmann | 190/901 |
| 3,263,779 | 8/1966 | Bialer | 190/110 |
| 4,738,340 | 4/1988 | Crespi | 190/111 |

FOREIGN PATENT DOCUMENTS

| | | | |
|---|---|---|---|
| 615757 | 1/1927 | France | 190/109 |
| 2653312 | 4/1991 | France | 190/110 |
| 415773 | 9/1934 | United Kingdom | 190/111 |

*Primary Examiner*—Gary E. Elkins
*Attorney, Agent, or Firm*—Saperston & Day

[57] ABSTRACT

A component carrying case has a plurality of individual storage compartments that are covered by sliding transparent sheets. An interior component box which also contains individual storage compartments with sliding covers lies within the case and is attached to a three-leaf hinge configuration that enables the interior component box to swivel from one side of the case into the other without interfering with the opening or closing of the case.

6 Claims, 3 Drawing Sheets

UTILITY COMPONENT BRIEFCASE

FIELD OF INVENTION

The disclosed device is within the field of carrying cases, specifically carrying cases which are specially adapted to holding small articles and which include an independently moveable interior compartment for increased storage capacity and access.

BACKGROUND OF INVENTION

Carrying cases in all trades are necessary for the tradesman to perform his trade efficiently. A proper carrying case must be capable of holding many parts of different sizes and keeping these parts separate. It must also be portable so as to allow the tradesman to have easy access to the necessary parts or components. Without the aid of the carrying case, the tradesman would have to return to his truck or storage room whenever the need arose for a part that he did not have readily available. These constant returns to the truck or storage room greatly reduce the tradesman's efficiency and, hence, increase his job performance time which results in higher cost to the consumer. Even in the case of a tradesman who is not performing a service for payment, the inconvenience of returning for small parts takes away from time to work on the project. Many times when more time is spent on running back to get parts or supplies, the level of interest in the project declines. Therefore, any time-saving techniques or devices are quite helpful.

Even though many tradesmen such as artists and carpenters use utility boxes to hold their supplies, these boxes do not sufficiently keep the small parts from mixing in with other parts while the box is being carried. Once these parts get mixed together, the tradesman must spend time in separating them and/or searching for the desired part. As a result, the tradesman's efficiency declines.

In order to solve the problems of separate storage locations and mixing of parts, a carrying box that can contain a variety of storage compartments of different sizes that keep the individual parts from mixing in with each other, and that is easily carried, is desirable.

A variety of carrying cases for containing all sizes of parts has been designed and marketed. However, some of these previous designs are unable to keep the parts totally separated during transportation and, therefore, do not solve the existing problem of commingling of parts. Other designs that are capable of keeping small parts separate are not easily carried by the tradesman. Still other designs that can keep small parts separate and that are portable do not contain a sufficient portion of storage space. That is, these cases are relatively small and the tradesman is faced with carrying several individual boxes. As the tradesman is forced either to carry several small boxes, separate small parts, or return to a permanent storage base, his time for job performance decreases and as a result his job efficiency declines. This invention seeks to create a portable carrying case that is capable of keeping a large number of parts separate and has special utility for artisans and craftsmen who must have frequent access to small parts, supplies, and tools.

The prior devices marketed for use as utility component carrying cases utilize either a tray system of shelves that are hinged together to fold outward or a divider to separate the individual sides of the carrying case. These prior devices are capable of containing a variety of small parts within the case; however, none of these prior devices can prevent these small parts from mixing together during a transitory period such as from truck to work site. As a result of this mixing, the tradesman spends a large portion of his time separating the parts in order to locate the desired part. Also, these prior devices are limited in the space that is available for storage. Most of these devices contain only a few compartments of different size, and, therefore, the user is restricted in what he can place in the carrying case. Since there are restrictions in what can be placed in any one case, the user is forced to carry several cases and search through each case to locate the correct part.

Thus, it is an objective of the within invention to provide a utility component carrying case that can provide a means of keeping individual components secure, yet easily accessible, inside their individual compartments.

Another objective of the within invention is to provide a utility component carrying case that when in the open position presents all compartments for ready access.

Yet another objective is to provide a case with multiple interior chambers that are each arranged for access without interfering with access to others.

A final objective is to provide a novel hinging system that will enable movement of independent interior compartments within a case.

These and other objectives are achieved in novel fashion by the invention described below.

SUMMARY OF THE INVENTION

The utility component carrying case described herein addresses the problems of mixing of parts and limited sized storage compartments by providing sliding transparent covers that fit over the interior compartments and by providing an independent interior storage box that rotates to each side of the carrying case and allows storage within the inner box without interfering with compartments in the case itself. Since the covers slide over the top of the compartments, the covers secures components without the excess space required by a hinged lid. The inner box, which flips from one side of the carrying case to the other, works to maximize storage space by using otherwise dead interior space and enabling more small individual compartments. Access to either side of the inner box is enabled without disturbing the orientation of the entire case by hinging the inner box to the same hinge pin as the case hinge. As will be seen in the description of the preferred embodiment which follows, your applicant has considered and rejected a great number of alternate constructions in favor of those that most efficiently accomplish the stated purposes.

DETAILED DESCRIPTION OF THE PREFERRED EMBODIMENTS

Figure 1:
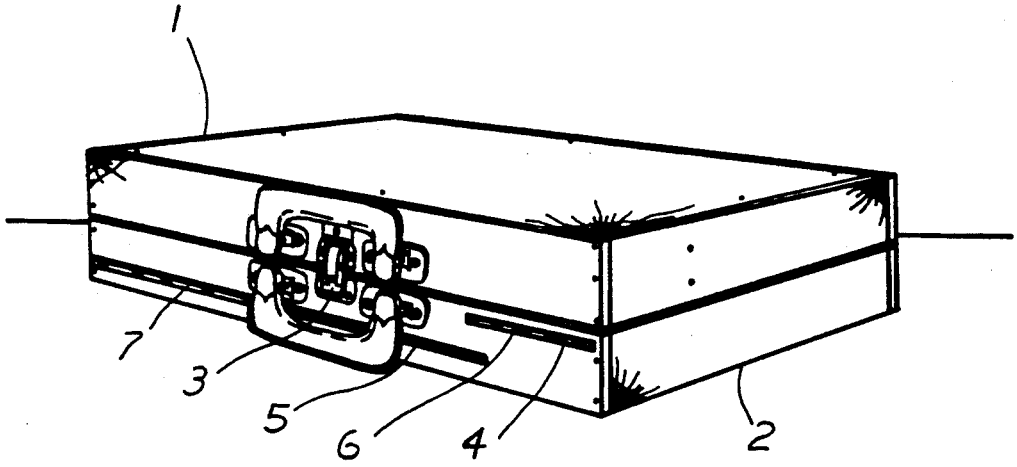
FIG. 1 is a perspective view of the utility component carrying case in the closed position.

Referring now to the drawings, the perspective view of FIG. 1 illustrates a typical utility carrying case in suitcase style composed of two mating half-cases, a first half-case 1 and a second half-case 2, each containing divided storage areas and compartments as will be seen in later drawings. Carrying handle elements may be attached to the forward portions of the half-cases to facilitate transporting the case. Latching mechanism 3 is provided to secure the case in closed position. As will also be shown in later drawings, at least some of the interior compartments are covered with sliding lids, generally of transparent sheet material, and the lids are configured to slide to open the interior compartments through slots in the walls of the carrying case, typical slots being shown in FIG. 1 as 4 and 5. The edges of interior compartment covers 6 and 7 may be seen in FIG. 1 protruding through slots 4 and 5 respectively.

Figure 2:
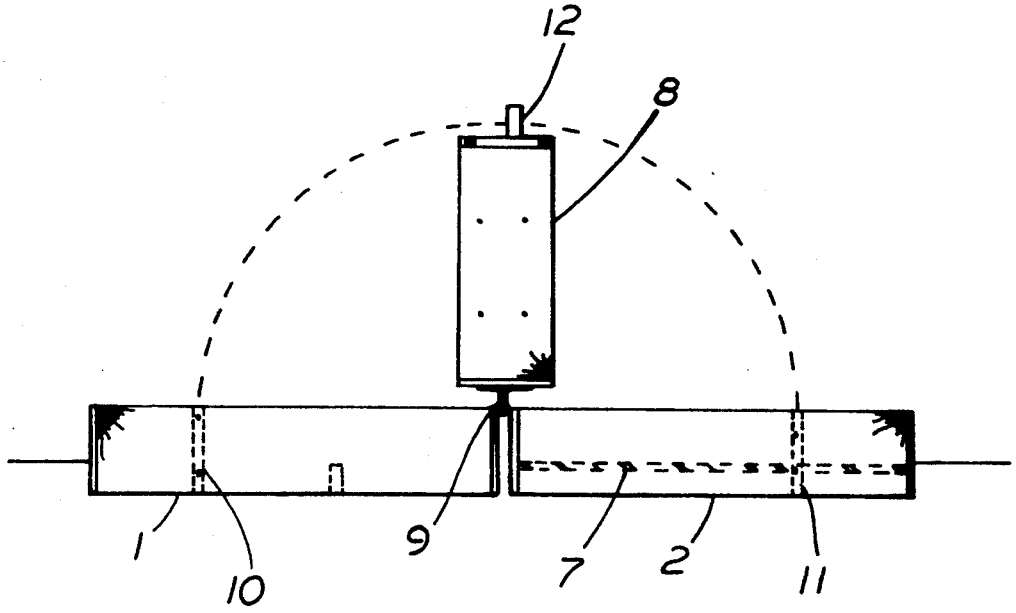
FIG. 2 is a side view of the utility component carrying case in the open position with dotted lines to show the range of motion in which the inner flip-flop box travels, and hidden lines show the placement of interior storage compartments.

FIG. 2 is a perspective view of the utility component carrying case lying flat in the open position with dotted lines showing the range of motion in which the inner storage box 8 may travel. It is the adaptation of the inner storage box that makes the present invention particularly useful in transportation of separated parts and tools while maximizing both the number and arrangement of storage compartments and access each of the compartments. It is the unique hinging arrangement that makes the inner storage compartment able to flip-flop from side to side without disturbing any of the other compartments or the orientation of the half-cases in open position, thus enabling access to compartments in the inner flip-flop compartment from either side. A segmented hinging mechanism 9 enables independent movement of the first and second half-cases and the inner storage compartment about the same hinge pin axis. Also shown in FIG. 2 in hidden lines are various interior storage walls such as 10 and 11 and sliding lid 7 in the first and second half-cases. The inner flip-flop box is presented as a generally rectangular configuration to conform to the interior of the suitcase configuration shown but could be configured to any convenient nesting symmetrical shape. A stop-ledge 12 is provided to position and support the flip-flop box in either horizontal position as the stop comes into contact with inner divider 10 or 11.

Figure 3:
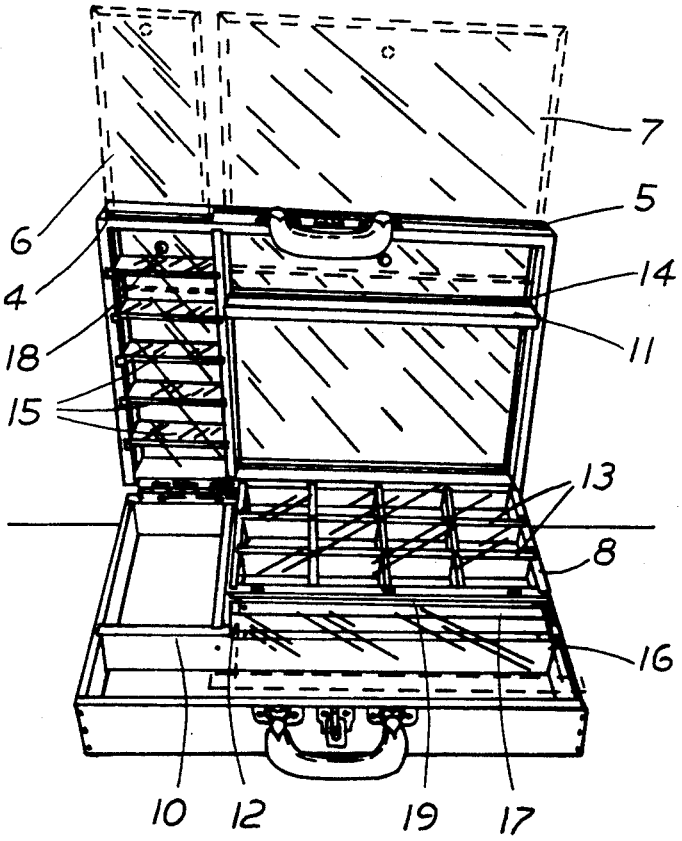
FIG. 3 is a perspective view of the utility component carrying case in the open position showing the inner storage compartments, inner flip-flop box, and transparent covers.

FIG. 3 is a perspective view of the utility component carrying case in the open position which reveals the inner workings of the case. The large sliding cover 7 slides through the large slot 5. The smaller sliding cover 6 slides through slot 4 in the upper edge of the upper half-case as oriented and displayed in FIG. 3. Large cover 7 covers two defined interior compartments separated by interior divider 11 which contains a pass-through slot 14. Similarly, the smaller sliding cover 6 securely covers a series of interior compartments each separated by interior dividers 15 and containing the parts or tools carried therein by fitting over the upper edges of the interior dividers. In similar fashion various other internal compartments in either half-case may be customized and configured or enclosed with the sliding lids in variously-placed interior dividers.

Further referring to FIG. 3, it can also be seen that the interior flip-flop compartment 8 is subdivided in the orientation shown by dividers 13 forming a grid of interior compartments, and another sliding lid of sheet material 16 enclosing those compartments and sliding through slot 17 in the forward part of the interior compartment. Here the interior flip-flop box rests on one of the half-cases, its stop-ledge 12 resting on interior divider 10 and nesting into the supporting half-case. In this configuration, thus, access is enabled to all of the compartments in the upper half-case, the compartments in the lower half-case which are not underneath the nesting flip-flop compartment, and those compartments in the flip-flop case at the upper exposed surface. The following views illustrate how access is conveniently managed to all the compartments including those underneath the flip-flop case in this view and compartments on the other side of the flip-flop case. It can also be seen that use of sliding covers to secure the compartments enables a close fit of the various arrangements of interior compartments with no wasted space reserved for movement or removal of lids or doors. It also enhances usefulness of the case for the sliding lid covers to be transparent to be able to view the contents of almost all of the compartments simultaneously. In order to further conserve otherwise wasted space, no knobs or catches are used in the interior, as the sliding covers require only a small index hole 18 for grasping and moving the sliding covers. Alternatively, some of the covers may have an exterior bar along one edge to act both as a stop and a grasping handle for moving the sliding cover such as edge 19 on the flip-flop box cover shown.

Figure 4:
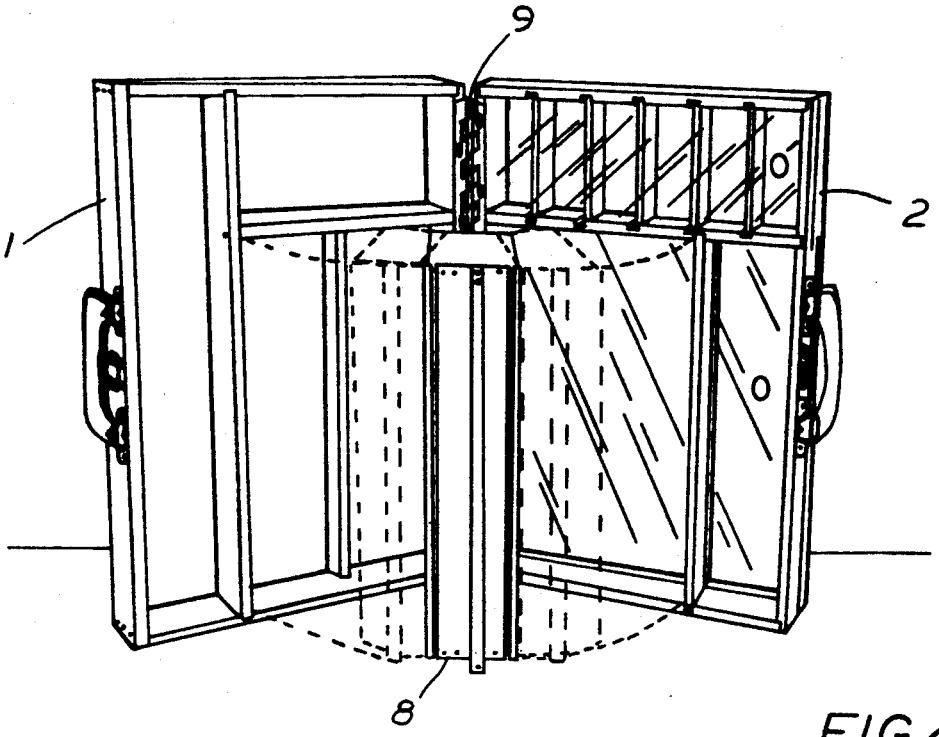
FIG. 4 is a perspective view of the utility component carrying case in the open position to show the range of motion in which the inner flip-flop box travels.

FIG. 4 makes clear on another orientation that the interior flip-flop box 8 moves in such fashion as to nest in either the first half-case 1 or the second half-case 2 among the interior dividers and compartments in either half-case, and that the rotational movement to the nesting position is maintained by hinging the interior compartment around the same hinge pin axis as moves both the mating half-cases. A piano-style hinge 9 is illustrated here, and in the portion of that piano hinge along the length of the interior flip-flop box additional hinge-leafs must be incorporated to attach the flip-flop box to the hinge axis, as further illustrated in FIGS. 5 and 6.

Figure 5:
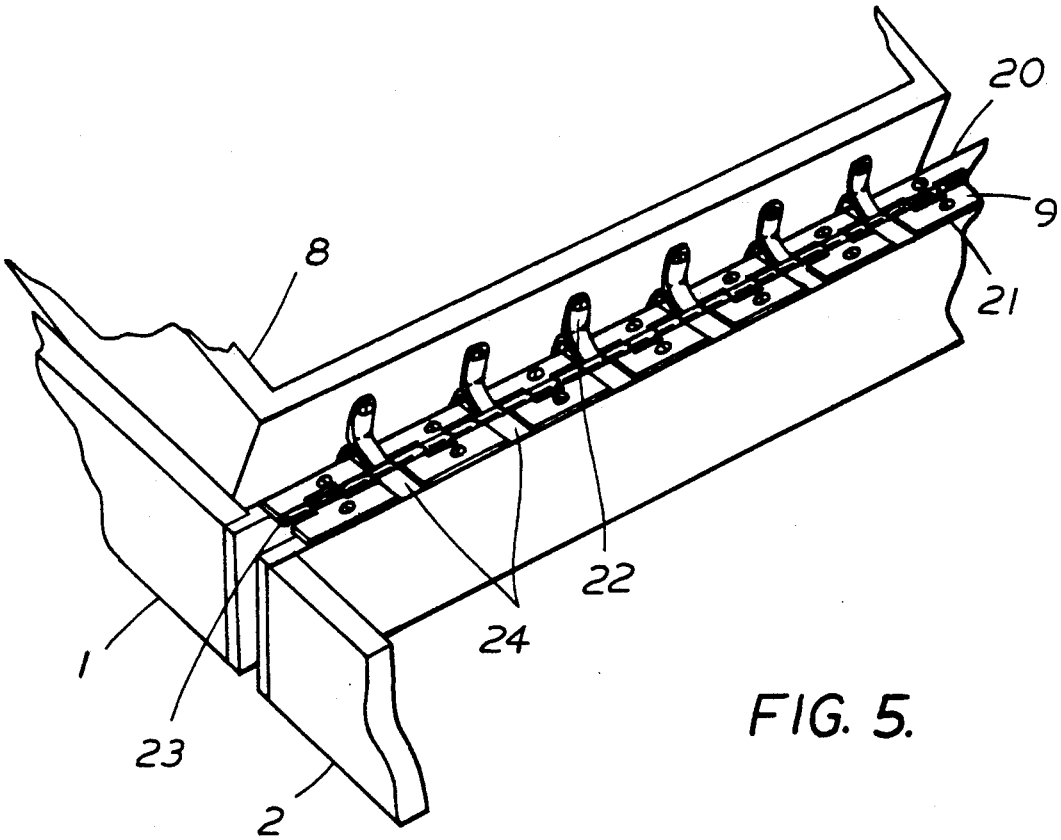
FIG. 5 is a cutaway perspective view of the utility component carrying case showing one portion of the hinge system attached to both halves of the carrying case and the inner flip-flop box.

FIG. 5 illustrates a partial view of half-cases 1 and 2 and a partial view of interior flip-flop box 8 now revealing the exact configuration of the hinge underlying the flip-flop box. The piano-style hinge 9 is shown as a discontinuous section, and the remainder of the length of the hinging system shown consists not only of the left leaf 20 and the right leaf 21 for attachment to the hinging edges of half-cases 1 and 2 respectively, but further that a third type of hinge-leaf 22 must be provided for attachment of the hinging edge of the interior flip-flop box. The third type of hinge-leaf 22 is provided as a footed T-shaped configuration in this view for secure attachment of the flip-flop box and the stem portion of the T-shaped configuration extending to the hinge pin 23 which extends the entire length of the hinge assembly to contain each leaf for rotation about the axis formed by the pin. As the flip-flop box is nested to either side, the stem portion of the T-shaped leaf will move into the same plane as either the left leaf hinge-leaf 20 right hinge-leaf 21. In order to lie flat and avoid interfering contact with either of those hinge-leafs, cut-away openings 24 in the right or left hinge-leaf are provided. Thus, it can be seen that as the entire case is opened and laid out on a flat surface, access to either side of the interior flip-flop box can be had by moving that box into either its left nesting position in half-case 1 or its right nesting position in half-case 2, and that in either nesting position the footed attachment hinge-leaf section 22 will lie flat without interfering with either left hinge 20 or right hinge-leaf 21. Thus, either side of the flip-flop box is made accessible in fully horizontal position, and the box can be divided transversely in compartments provided on either side of the box, each with its own sliding lid. This enables the number of small part divisions and compartments to be increased and enhances the utility of the box for carrying small parts and tools and presenting them in accessible fashion.

Figure 6:
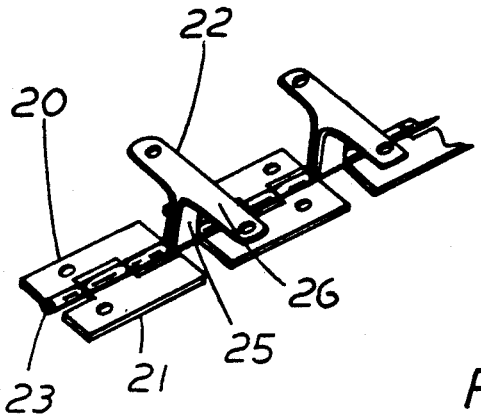
FIG. 6 is a perspective view showing a portion of the utility component carrying case's hinging system and the individual elements that make up this hinging system.

FIG. 6 shows the hinging system apart from the other elements of the utility component carrying case. Left leaf 20 is formed around a hinge pin 23 that continues the length of the carrying case. Right leaf 21 is also formed around the hinge pin 23 but has its mounting area on the right side. The T-shaped leaf 22 is formed around the hinge pin 23 at the stem portion 25 and has a mounting area at the cross portion 26. Thus, it can be seen that the hinge system is composed of three separate hinge-leaf components, 20, 21, and 22, which are arranged in repeating fashion along the entire length of the hinge pin which is approximately the length of the hinged edges of the entire carrying case. This can either be accomplished by providing separate short components as illustrated in FIG. 6 and threading them in repeating fashion along the hinge pin, or it could be accomplished by starting with a continuous piano hinge and cutting away sections in the right and left leafs where the third type T-shaped leaf would be inserted.

The hinging system illustrated is essentially a three-leaf hinging system where the first two leafs connect the halves of the case and the third leaf attaches the interior compartment and enables it to rotate about the same hinge access. Of course, spaces must be provided between the first and second hinge-leafs to enable complete closure without interference by the third leaf. The spaces can be provided either by cutting away sections of the first hinge-leaf or the second hinge-leaf or both or by assembling the first and second hinge-leafs from a series of discrete smaller hinge-leaf components and inter-spacing discrete third hinge-leaf components. Thus, the entire assembly could be arranged along a unitary hinge pin by inserting in order a left-facing hinge-leaf component, a footed hinge-leaf component for attachment to the interior box, a right-facing hinge-leaf component, a left-facing hinge-leaf component, a footed-component, and so forth along the entire length of the hinge pin. The third hinge-leaf component for attachment to the interior box is also different in kind than the first and second hinge-leaf components which are attached flat each to an edge of one of the half-cases, in that the third hinge-leaf component extends upward for attachment to a surface that is perpendicular to the hinge-leaf and requires an attachment foot. Thus, the general configuration of the third hinge-leaf component would be a T-shape or an L-shape or an equivalent footed structure.

The description reveals that the utility component carrying case provides added storage capacity through use of the inner flip-flop box 15 but minimizes the amount of space that is needed to support such a component. Minimizing the consumption of space is achieved by utilizing one hinge system with multiple attachments to bring together several components of the device, namely first half-case 1, second half-case 2 and inner flip-flop box 8. It is this combination of the hinge elements that allows for the hinge system to perform two separate functions; one being the joining of first half-case 1 and second half-case 2 and the other being the means for allowing inner flip-flop box 8 to rotate easily from side to side. This effectively enables a relatively flat design of the carrying case and adaptability to flat designed standard case shapes such as a briefcase. By contrast, other multi-compartmented utility carrying cases have been bulkier or presented in upright fashion necessitating articulating hinges and other complicated or space-consuming devices to enable access to the interior compartments. The flat design is particularly useful in that the case can be laid out on a flat surface displaying almost all of the interior compartments and making ready access to any concealed compartments by merely flip-flopping the interior box. The use of sliding covers also maintains the contents securely when the entire box is closed as none of the interior lids will open regardless of the orientation of the box in closed position.

From the detailed description provided above, it can be seen that the major objectives of the invention have been achieved, that is a utility component carrying case that keeps individual components separate and secure in their individual compartments. Multiple-sized storage compartments are created as a result of the placement of dividers and the rotating flip-flop box. Also, with the rotating inner flip-flop box and flat design storage space is maximized because components can be stored both in the flip-flop box and underneath it.

While the utility component carrying case has been illustrated as the embodiment of the invention here reduced to practice, other sizes, shapes and styles of utility component carrying cases could easily be adapted to use the concept illustrated here.

Having described the within invention, I claim:

1. A carrying case for small articles comprising:

a first half-case;

a second half-case configured to mate to said first half-case to form a closed case;

each said half-case containing a plurality of divided storage compartments;

an interior container nesting between said first and second half-cases when said half-cases are in the mated position, said interior container having at least one storage compartment; and hinging means joining one edge of each half-case and a side of said interior container such that both half-cases and the interior container may move about the same hinge axis without interference.

2. The device of claim 1 wherein the hinging means further comprises:

a first hinge-leaf assembly fastened to said first half-case;

a second hinge-leaf assembly fastened to an edge of said second half-case; and a third hinge-leaf assembly interposed between said first and second hinge-leafs, said third hinge-leaf assembly having a foot for attachment to said interior container; and a hinge pin joining together said first, second, and third hinge-leafs.

3. The device of claim 2 wherein the first hinge-leaf is a continuous hinge-leaf with sections cut away to enable said third hinge-leaf assembly to lie in the same plane as said first hinge-leaf assembly when the entire case and hinge is in the closed position.

4. The device of claim 2 wherein said first hinge-leaf is comprised of a plurality of discrete hinge-leaf sections, said second hinge-leaf means is comprised of a plurality of discrete hinge-leaf sections, said third hinge-leaf means is comprised of a plurality of discrete hinge-leaf sections, and said discrete hinge-leaf sections are arranged along the hinge pin in a regular repeating series.

5. The device of claim 1 further comprising a sliding lid built into at least one of said half-cases, covering at least one storage compartment and configured to slide approximately parallel to the major plane defined by the shape of the interior space of the carrying case.

6. The device of claim 1 further comprising at least one sliding cover covering at least one compartment within said interior container and configured to slide in a plane parallel to the major plane of the space defined by the carrying case.

* * * * *